US009939136B2

(12) United States Patent
Vidal

(10) Patent No.: US 9,939,136 B2
(45) Date of Patent: Apr. 10, 2018

(54) LED LIGHT FIXTURE WITH ADJUSTABLE MOUNTING MECHANISM

(71) Applicant: GREEN CREATIVE, LTD, Hong Kong (CN)

(72) Inventor: Guillaume Vidal, Mende (FR)

(73) Assignee: Green Creative Ltd, Hong Kong (CN)

( * ) Notice: Subject to any disclaimer, the term of this patent is extended or adjusted under 35 U.S.C. 154(b) by 0 days.

(21) Appl. No.: 15/330,142

(22) Filed: Aug. 15, 2016

(65) Prior Publication Data

US 2017/0038042 A1 Feb. 9, 2017

(51) Int. Cl.

| | |
|---|---|
| ***F21V 21/14*** | (2006.01) |
| ***F21K 99/00*** | (2016.01) |
| ***F21V 21/04*** | (2006.01) |
| ***F21V 23/04*** | (2006.01) |
| ***F21S 8/02*** | (2006.01) |
| ***F21V 23/00*** | (2015.01) |
| ***F21V 23/02*** | (2006.01) |
| ***F21K 9/232*** | (2016.01) |
| *F21Y 115/10* | (2016.01) |

(52) U.S. Cl.

CPC ..... *F21V 21/14* (2013.01); *F21K 9/232* (2016.08); *F21S 8/026* (2013.01); *F21V 21/042* (2013.01); *F21V 23/003* (2013.01); *F21V 23/02* (2013.01); *F21V 23/04* (2013.01); *F21V 21/049* (2013.01); *F21Y 2115/10* (2016.08)

(58) Field of Classification Search

CPC .... F21V 21/041; F21V 21/042; F21V 21/046; F21V 21/047; F21V 21/048; F21V 21/049; F21V 21/14; F21V 23/003; F21V 23/02; F21V 23/04; F21S 8/026; F21K 9/232

USPC ..... 362/364–366, 147–150

See application file for complete search history.

(56) References Cited

U.S. PATENT DOCUMENTS

| | | | | |
|---|---|---|---|---|
| 5,964,523 | A * | 10/1999 | Eversberg | F21V 21/04 362/148 |
| 6,000,818 | A * | 12/1999 | Caluori | F21V 21/04 362/147 |
| 7,281,697 | B2 * | 10/2007 | Reggiani | F21V 21/04 248/221.11 |
| 8,920,004 | B2 * | 12/2014 | Song | F21V 21/044 362/147 |
| 9,052,101 | B1 * | 6/2015 | Kathawate | F21V 21/046 |
| 9,310,038 | B2 * | 4/2016 | Athalye | F21V 21/00 |
| 2015/0085499 | A1 * | 3/2015 | Mandy | F21V 21/046 362/365 |

* cited by examiner

*Primary Examiner* — Alan Cariaso

(74) *Attorney, Agent, or Firm* — James A. Gavney, Jr.; JAG Patent Services

(57) ABSTRACT

A LED light fixture is disclosed with an adjustable mounting mechanism. The adjustable mounting mechanism includes lever features that are mechanically coupled to the adjustable flanges. The lever features ratchet or move downward to sandwich portions of a ceiling that surround a ceiling recess hole between the adjustable flanges and the lever features to secure the LED light fixture within the ceiling recess hole. The LED light fixture also includes a power source with a dimmer switch that allows DC power output from the power unit to be adjusted and dim light output emitted from the LED light fixture.

5 Claims, 2 Drawing Sheets

LED LIGHT FIXTURE WITH ADJUSTABLE MOUNTING MECHANISM

FIELD OF THE INVENTION

This invention relates to recessed ceiling down-lighting. More particularly, the present invention relates to a recessed LED ceiling down-light.

BACKGROUND OF THE INVENTION

A light-emitting diode (LED) is a two-lead semiconductor light source. It is a pn-junction diode, which emits light when activated. When a suitable voltage is applied to the leads, electrons are able to recombine with electron holes within the device, releasing energy in the form of photons. This effect is called electroluminescence, and the color of the light (corresponding to the energy of the photon) is determined by the energy band gap of the semiconductor.

Recent developments in LEDs permit them to be used in environmental and task lighting. LEDs have many advantages over incandescent light sources including lower energy consumption, longer lifetime, improved physical robustness, smaller size, and faster switching. Light-emitting diodes are now used in applications as diverse as aviation lighting, automotive headlamps, advertising, general lighting, traffic signals, and camera flashes.

Currently available recessed light fixtures are not compatible with a range of ceiling recesses configurations, are generally not configured to power LED lightbulbs and are difficult to install or secure to the ceiling.

SUMMARY OF INVENTION

The present invention is directed to a recessed ceiling mounted LED light fixture, hereafter LED light fixture. The LED light fixture includes housing for fitting into a ceiling recess hole and shielding an LED lightbulb. The LED light fixture also include a power unit on top of the housing for providing DC output power to the LED lightbulb from a power source. Preferably, the power unit has a switch for selecting a range of DC power outputs. The LED light fixture also includes an adjustable mounting mechanism attached the housing that includes flanges that expand and contract to fit near edges of the ceiling recess hole and ratchet levers that move downward to a closed position and sandwich portions of edges surrounding the ceiling recess hole between portions of the levers and portions of the flanges. This adjustable mounting mechanism allows the LED light fixture to be secure within ceiling recess holes having a range of different sizes.

DETAILED DESCRIPTION

Figure 1:
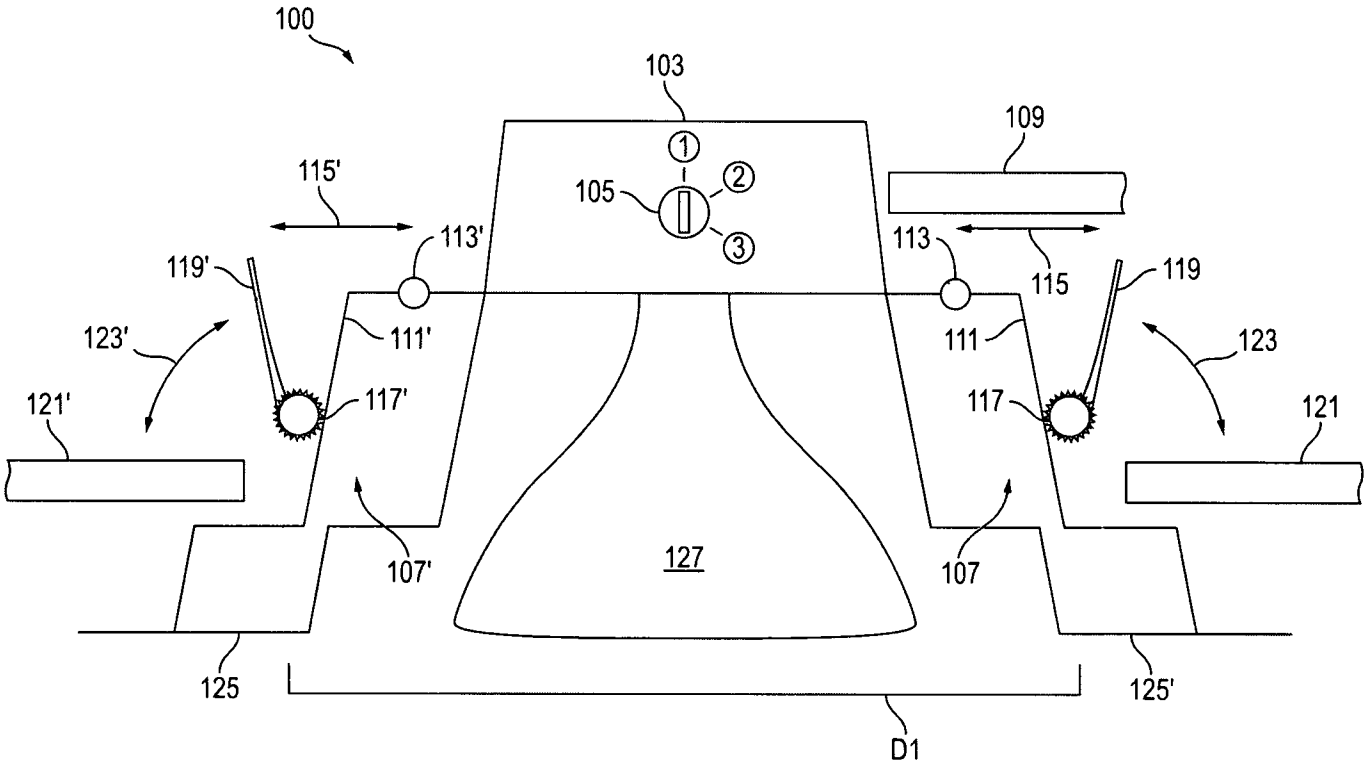
FIG. 1 shows an cross-sectional view of the LED light fixture with an adjustable mounting mechanism, in accordance with the embodiments of the invention.

The present invention is directed to a recessed ceiling mounted LED light fixture 100, hereafter LED light fixture.

The LED light fixture 100 includes a housing structure 125 and 125' that fits into a ceiling recess hole and shields an LED lightbulb 127. The LED light fixture 100 further includes a power unit 103 positioned on top of the housing structure 125. Within the power unit 103 is an LED driver circuit (not shown) for powering the LED lightbulb 127 from an external power source 109. The power unit 103 Preferably includes a dimmer switch 105 that allows DC power output from the power unit 103 to be adjusted (1, 2 and 3) and dim light output emitted from the LED lightbulb 127.

The LED light fixture 100 also includes an adjustable mounting mechanism 107 and 107'. The adjustable mounting mechanism 107 and 107' includes flanges 111 and 111' that are adjustable through lock and/or slide features 113 and 113' to adjust a width D1 or a separation between the flanges 111 and 111', as indicated by the arrows 115 and 115'

The adjustable mounting mechanism 107 and 107' further includes lever features 119 and 119' that are mechanically coupled to the flanges 111 and 111' through ratchet features or gear and/or spring release mechanisms 117 and 117'. The ratchet features or gear and/or spring release mechanisms 117 and 117' are configured to move downward or upward, as indicated by the arrows 123 and 123', to lock the lever features 119 and 119' into a desired position.

In operation the flanges 111 and 111' are adjusted to the width D1 that is suitable for placing the housing structure 125 into a ceiling recess surrounded by ceiling edges 121 and 121'. The lever features 119 and 119' are then released and lock into a downward position, such that the ceiling edges 121 and 121' are sandwiched between the lever features 119 and 119' and portions of the flanges 111 and 111' thus securing the LED light fixture 100 within the ceiling recess hole. In this way, the LED light fixture 100 is capable of being installed in ceiling recesses having a range of sizes and the lighting output from the LED lightbulb 127 can be selected or changed through the dimmer switch 105 without installing expensive dimmer switches.

Figure 2:
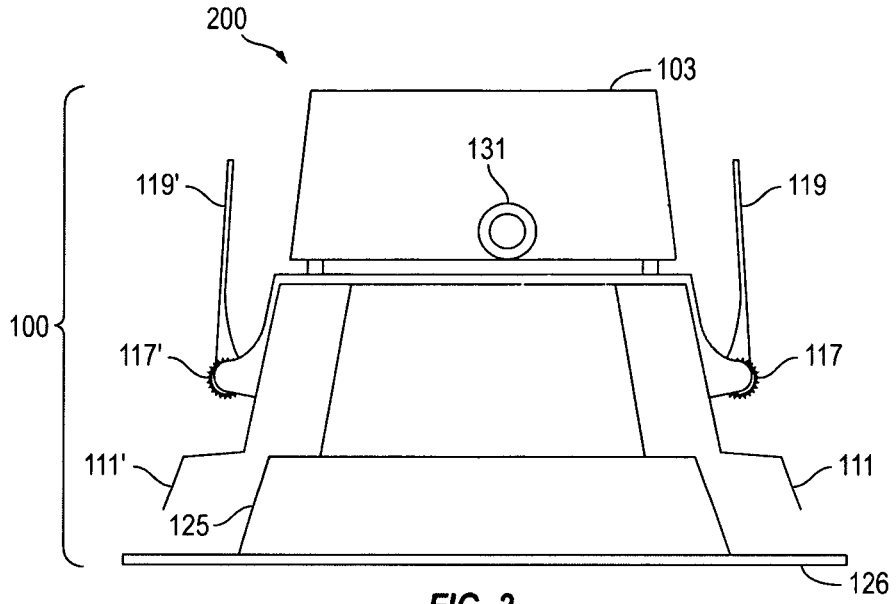
FIG. 2 shows a side-view of the LED light fixture with an adjustable mounting mechanism, in accordance with the embodiments of the invention.
Figure 3:
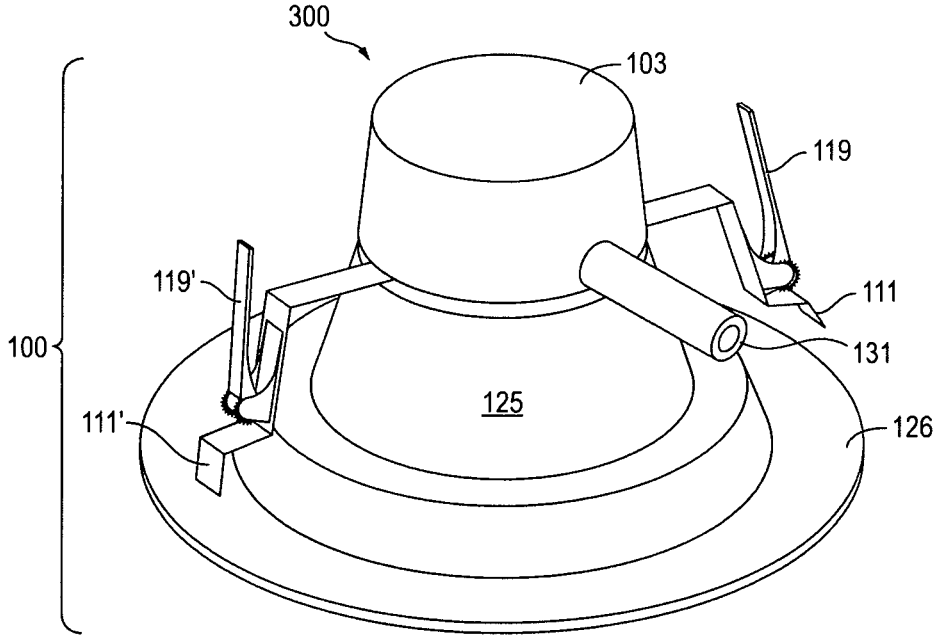
FIG. 3 shows perceptive-view of the LED light fixture with an adjustable mounting mechanism, in accordance with the embodiments of the invention.

FIGS. 2-3 shows a side-view 200 and a perceptive-view 300 of the LED light fixture 100 with an adjustable mounting mechanism such as described above with reference to FIG. 1. The LED light fixture 100 includes a housing structure 125 with a decorative lip 126 that fits into a ceiling recess and shields an LED lightbulb (not shown). The LED light fixture also includes an adjustable mounting mechanism with lever features 119 and 119' that are mechanically coupled to the flanges 111 and 111' through ratchet features or gear and spring release mechanisms 117 and 117'. The ratchet features or gear and spring release mechanisms 117 and 117' that are configured to move downward or upward, as described above.

The LED light fixture also includes a power unit 103 positioned on top of the housing structure 125 that coupled to an external power source 109 (FIG. 1) through a conduit 131. The power unit 103 preferably includes a dimmer switch 105 (FIG. 1) that allows a DC power output from the power unit 103 to be adjusted and dim light output emitted from the LED lightbulb 127 (FIG. 1).

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An LED light fixture comprising:

a) a housing for fitting into a ceiling recess with ceiling edges and for shielding an LED lightbulb; and b) an adjustable mounting mechanism comprising:

i) flanges that are adjustable through lock and/or slide features to adjust a width or a separation between the flanges; and ii) lever features that are mechanically coupled to the flanges through ratchet features or gear and/or spring release mechanisms that are configured to move downward or upward to lock the lever features into a desired position and to sandwich a portion of ceiling edges between portions of the lever features and portions of the flanges to thereby secure the LED light fixture within the ceiling recess.

2. The LED light fixture of claim 1, further including a power unit with an LED driver circuit for power the LED light fixture.

3. The LED light fixture of claim 2, wherein the power unit includes a switch for selecting a range of DC power outputs.

4. An LED light fixture comprising:

a) a housing for fitting into a ceiling recess and shielding an LED lightbulb;

b) a power unit on top of the housing for providing DC output power to the LED lightbulb from a power source, the power unit having a switch for selecting a range of DC power outputs; and c) an adjustable mounting mechanism attached the housing that includes flanges with slide features to adjust a width or a separation between the flanges to fit near edges of the ceiling recess and lever features that are mechanically coupled to the flanges through ratchet features that move to sandwich portions of the ceiling edges between portions of the lever features and portions of the flanges to thereby secure the LED light fixture within the ceiling recess.

5. An LED light fixture comprising:

a) a housing for fitting into a ceiling recess with ceiling edges and for shielding an LED lightbulb;

b) a power unit on top of the housing for providing DC output power to the LED lightbulb from a power source, the power unit having a switch for selecting a range of DC power outputs; and c) an adjustable mounting mechanism comprising:

i) flanges that are adjustable through lock and/or slide features to adjust a width or a separation between the flanges; and ii) lever features that are mechanically coupled to the flanges through ratchet features or gear and/or spring release mechanisms that are configured to lock the lever features into a downward position and to thereby sandwich a portion of ceiling edges between portions of the lever features and portions of the flanges and secure the LED light fixture within the ceiling recess.

* * * * *